US005863618A

United States Patent [19]

Jarosinski et al.

[11] Patent Number: 5,863,618

[45] Date of Patent: Jan. 26, 1999

[54] METHOD FOR PRODUCING A CHROMIUM CARBIDE-NICKEL CHROMIUM ATOMIZED POWDER

[75] Inventors: William John Crim Jarosinski, Indianapolis; Lewis Benton Temples, South Plainfield; Calvin Henry Londry, Indianapolis, all of Ind.

[73] Assignee: Praxair St Technology, Inc., Danbury, Conn.

[21] Appl. No.: 723,651

[22] Filed: Oct. 3, 1996

[51] Int. Cl.[6] ..... B22F 1/02; C22C 29/02; C23C 4/10

[52] U.S. Cl. ..... 427/450; 427/451; 427/456; 75/242; 75/255; 75/328; 75/956

[58] Field of Search ..... 427/450, 451, 427/456; 419/23; 75/357, 242, 255, 337, 338, 339, 623, 953, 956

[56] References Cited

U.S. PATENT DOCUMENTS

| | | | |
|---|---|---|---|
| 3,813,196 | 5/1974 | Backstrom et al. . | |
| 3,846,084 | 11/1974 | Pelton | 29/191.2 |
| 4,576,642 | 3/1986 | Holtz et al. | 75/239 |
| 4,671,932 | 6/1987 | Lutz et al. | 420/452 |
| 4,725,508 | 2/1988 | Rabgaswamy et al. | 428/570 |
| 5,126,104 | 6/1992 | Anand et al. | 419/12 |
| 5,137,488 | 8/1992 | Price et al. | 415/200 |

*Primary Examiner*—Shrive P. Beck
*Assistant Examiner*—Fred J. Parker
*Attorney, Agent, or Firm*—Robert J. Feltovic

[57] ABSTRACT

A method for producing an atomized powder of chromium carbide particles dispersed in a nickel chromium matrix in which chromium in the powder is from 55 to 92 weight percent of the powder.

19 Claims, 4 Drawing Sheets

METHOD FOR PRODUCING A CHROMIUM CARBIDE-NICKEL CHROMIUM ATOMIZED POWDER

FIELD OF THE INVENTION

The present invention relates to a method for producing an atomized powder of chromium carbide particles dispersed in a nickel chromium matrix.

BACKGROUND OF THE INVENTION

Atomization technology is the breakup of a liquid into small droplets, usually in a high-speed jet or film. The production of high-quality powders, such as aluminum, brass, nickel alloys, cobalt alloys, wear resistant steel, and the like have been produced using the atomization technology. As simply defined, atomization is the breakup of a liquid to form droplets, typically smaller than about 150 $\mu$m. The breakup of a liquid stream brought about by the impingement of high-pressure jets of water or gas is referred to as water or gas atomization, respectively. The use of centrifugal force to break up a liquid stream is known as centrifugal atomization; the use of vacuum is known as vacuum atomization and the use of ultrasonic energy to effect breakup of a liquid stream is referred to as ultrasonic atomization. By regulating the parameters of the atomization process, the particle size, particle size distribution, particle shape, chemical composition and microstructure of the particles can be varied.

Conventional water and gas atomization processes presently account for the bulk of atomized metal powders. Water-atomized powders generally are quite irregular in shape and have relatively high surface oxygen contents. Gas-atomized powders, on the other hand, generally are more spherical or rounded in shape and, if atomized by an inert gas, generally have lower oxygen (oxide) contents. The major components of a typical atomization installation include a melting facility, an atomizing chamber, and powder drying (for water atomization) equipment. Melting of metals follows standard procedures. Air, inert gas and vacuum induction melting, arc melting, and fuel heating are suitable procedures.

The molten metal can be poured into a tundish, which is essentially a reservoir that supplies a uniform and controlled flow of molten metal to the tundish nozzle. The nozzle, which can be located at the base of the tundish, controls the shape and size of the metal stream and directs it through an atomizing nozzle system in which the metal stream is disintegrated into fine droplets by the high-velocity atomizing medium. Liquid droplets cool and solidify as they settle to the bottom of the atomization tank. This tank may be purged with an inert gas to minimize or prevent oxidation of the powder. In gas atomization, the powder may be collected as dry particles or cooled with water at the bottom of a tank. In dry collection, the atomization tank could be tall to ensure solidification of the powder particles before they reach the bottom of the collection chamber. Horizontal gas atomization using long horizontal tanks could also be used.

There are various types of gas and water nozzles known in the art to control the parameters of the atomization process to produce a desired powder product.

It is disclosed in the art that typical metal flow rates through single orifice nozzles could range from about 10 to 200 lb/min; typical water flow rates range from 30 to 100 gal/min at water velocities ranging from 230 to 750 ft/s and pressures from 800 to 3000 psi. Typical gas flow rates range from 40 to 1500 scfm at gas pressures in the range of 50 to 1200 psi. Gas velocities depend on nozzle design and may range from 60 ft/s to supersonic velocities. The temperature differential between the melting point of the metal and the temperature at which the molten metal is atomized (superheat of the molten metal) is generally about 75° to 300° C. (135° to 572° F.). There are many other variations to the atomization process known in the art to produce powder products.

U.S. Pat. No. 5,126,104 discloses a method for preparing an intimate mixture of powders of nickel-chromium-boron-silicon alloy, molybdenum metal powder, and $Cr_3C_2$/NiCr alloy suitable for thermal spray coatings which comprises milling a starting mixture of the above two alloys with molybdenum powder to produce a milled mixture wherein the average particle size is less than about 10 micrometers in diameter, forming an aqueous slurry of the resulting milled mixture and a binder which can be an ammoniacal molybdate compound or polyvinyl alcohol, and agglomerating the milled mixture and binder. The intimate mixture and binder may be sintered in a reducing atmosphere at a temperature of about 800° C. to 950° C. for a sufficient time to form a sintered, partially alloyed mixture wherein the bulk density is greater than about 1.2 g/cc. The resulting sintered mixture may be entrained in an inert carrier gas, passed into a plasma flame wherein the plasma gas can be argon or a mixture of argon and hydrogen, and maintained in the plasma flame for a sufficient time to melt essentially all of the powder particles of the sintered mixture to form spherical particles of the melted portion and to further alloy the sintered mixture, and cooled.

U.S. Pat. No. 3,846,084 discloses a composite powder for use in producing articles or coatings having unique wear and frictional characteristics consisting essentially of a chromium matrix with at least one chromium carbide taken from the class of carbides consisting of $Cr_{23}C_8$; $Cr_7C_3$; and $Cr_3C_2$ and each particle containing from about 0.2 wt. percent to about 5.4 wt. percent carbon.

U.S. Pat. No. 4,725,508 discloses the use of chromium carbide ($Cr_3C_2$) powder for use in thermal spray processes. Many of the chromium carbide powders are produced using the sintering techniques known in the prior art.

Although the atomization process has been known since 1945, it was not appreciated that this process could be used to produce a powder that contained a large volume fraction of chromium carbide phases.

It is an object of this invention to produce an atomized powder of chromium carbide particles dispersed in a nickel chromium matrix.

It is another object of this invention to produce powders using low cost raw materials and minimum process steps.

It is another object of the invention to produce an atomized powder of chromium carbide particles dispersed in a nickel chromium matrix in which the chromium is in an amount in weight percent of the powder from 55 to 91; the nickel in an amount in weight percent of 5 to 40 of the powder; and carbon in an amount in weight percent of 1 to 10 of the powder.

DESCRIPTION OF THE INVENTION

The invention relates to a method for producing an atomized powder of chromium carbide particle dispersed in a nickel chromium matrix, comprising the steps of melting chromium, carbon and nickel to form a liquid stream and then impinging a high pressure atomizing fluid selected from the group consisting of gas, liquid, and mixtures thereof to break up the liquid stream into droplets and then solidifying the droplets to form an atomized powder of chromium carbide particles dispersed in a metallic nickel chromium matrix.

The novel method of this invention recognizes that the physical ability to melt chromium, nickel and carbon can be used to produce chromium carbide-nickel chromium powder that contains a large volume fraction of chromium carbide phases, by gas or water atomization. Another novel aspect is the ability to control the type of chromium carbide ($Cr_7C_3$ and $Cr_{23}C_6$), amount (volume percentage), and size of the chromium carbide grains dispersed in the nickel chromium matrix by varying the chromium and carbon content. Also to be considered is the ratio of nickel to chromium in the metal matrix. By adjusting the amount of chromium higher and lowering the amount of nickel, a harder, more corrosion resistant and wear resistant binder phase is created.

The high weight percentage of chromium (55 wt % or greater) in the overall composition of an atomized powder made from a molten state using atomization is unique and novel. Additionally, the high chromium content and the presence of carbon result in a high volume percentage of fine (submicron to micron) chromium carbide phases, which are also unique and novel for an atomized powder. Preferably, the atomized powder particles are substantially spherical in shape.

In one embodiment of the invention at least two constituents from the group consisting of chromium carbide compounds, nickel chromium alloy, chromium, nickel and carbon are melted to produce a liquid stream. Preferably, the liquid stream should be heated between 1300° C. to 1900° C.; more preferably heated between 1500° C. to 1800° C.; and most preferably heated between 1650° C. to 1750° C. Preferably, the atomized powder of this invention should have a volume fraction of chromium carbide phase of greater than 0.25. More preferably, the volume fraction of the chromium carbide phase should be 0.5 or greater and preferably about 0.7.

When using the water atomization process, the pressure of the atomizing water could preferably be between 600 and 5000 psi. When using the gas atomization process, the pressure of the atomizing gas could be between 50 and 1200 psi. The pressure of the atomized fluid should be sufficient to break up the liquid stream into droplets having a diameter between 1 and 300 micrometers.

The components comprising the liquid stream should be sufficient to provide a powder with a chromium content of at least 55 weight percent of the powder and sufficient carbon to insure that the powder will contain a volume fraction of the chromium carbide phase in excess of 0.25. Preferably, the powder could contain $Cr7C_3$, $Cr_{23}C_6$ and mixtures thereof. Preferably, the volume fraction of the chromium carbide grains dispersed in the nickel chromium matrix could be 0.25 or greater and more preferably between 0.35 and 0.80. Preferably, the size of the chromium carbide grains could be between 1 and 20 micrometers, more preferably between 2 and 10 micrometers in its largest dimensions. The size and volume fraction of the chromium carbide grains can be adjusted by varying the chromium and carbon content. Preferably, the ratio of nickel to chromium in the atomized powder can be between 0.30 to 0.70 by weight in the metallic matrix. As stated above, the amount of the chromium in the metallic matrix can be increased and the amount of nickel can be lowered to make a powder that can be used to produce a harder, more corrosion resistant and wear resistant coating. The powders of the invention can be used to produce thermally deposited coatings and overlays and welding overlays for use in various applications using high velocity oxy-fuel, plasma, and/or detonation-gun.

The atomized powder, produced by the method of this invention would be comprised of chromium carbide particles dispersed in a nickel-chromium matrix, containing chromium in an amount in weight percent of the powder from 55 to 92, preferably 70 to 90 wt %; nickel in an amount in weight percent of 5 to 40, preferably 5 to 28 wt % of the powder; and carbon in an amount in weight percent of 1 to 10, preferably 2 to 6 wt % of the powder.

In some applications, it would be beneficial to add at least one element selected from the group consisting of boron (B), silicon (Si), manganese (Mn), phosphorus (P), or the like as a melting point suppressant or flux for the liquid streams. Generally an amount of the addition would be less than 5 weight percent of the powder and preferably between 0.03 and 2.0 weight percent.

EXAMPLE 1

Figure 1:
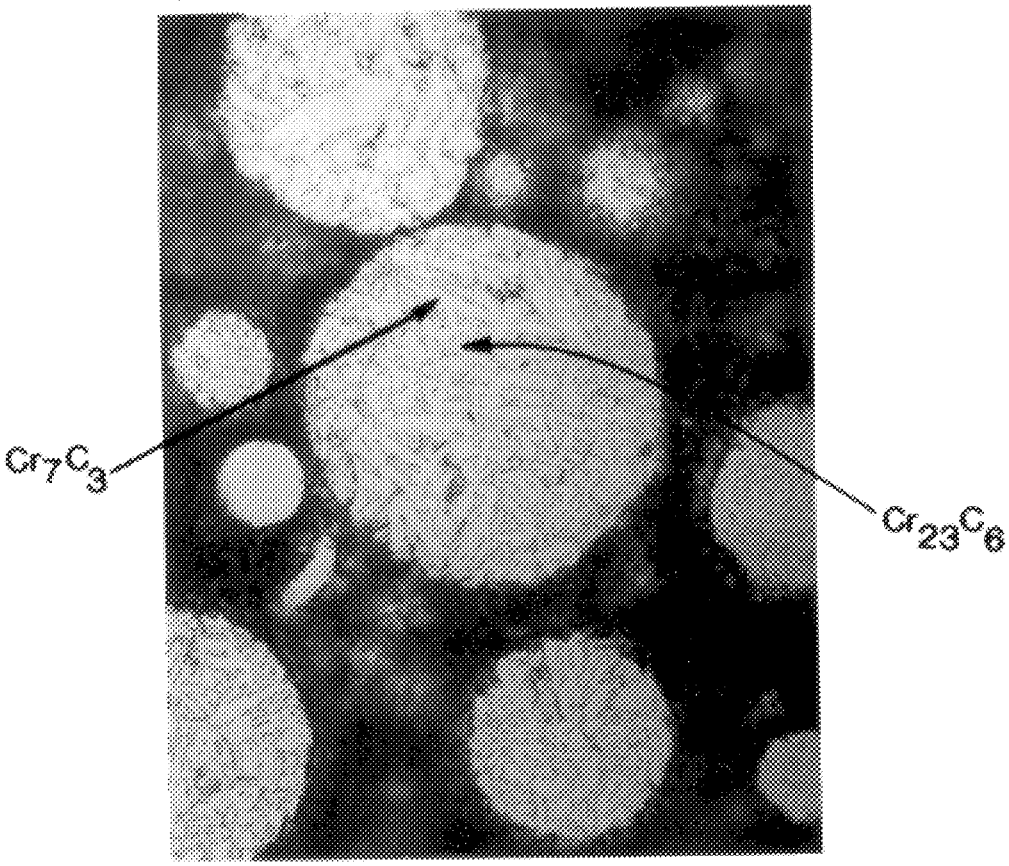
FIG. 1—Shows a photomicrograph at 500× magnification of chromium carbide nickel chromium powder atomized particles produced according to this invention (Example 1) containing large carbide grains ($Cr_7C_3$ and $Cr_{23}C_6$) resulting from a medium carbon and medium chromium level.

A mixture of 27 wt % chromium carbide and 73 wt % of nickel chromium in the mixture was heated to about 1700° C. to produce a liquid stream. An atomizing fluid of argon gas at a pressure of 800 psi was used to break up the liquid stream into droplets and then the droplets solidified to form an atomized powder. The powder had a composition of about 75.5 wt % Cr, 21 wt % Ni and about 3.5 wt % C (See FIG. 1).

EXAMPLE 2

Figure 2:
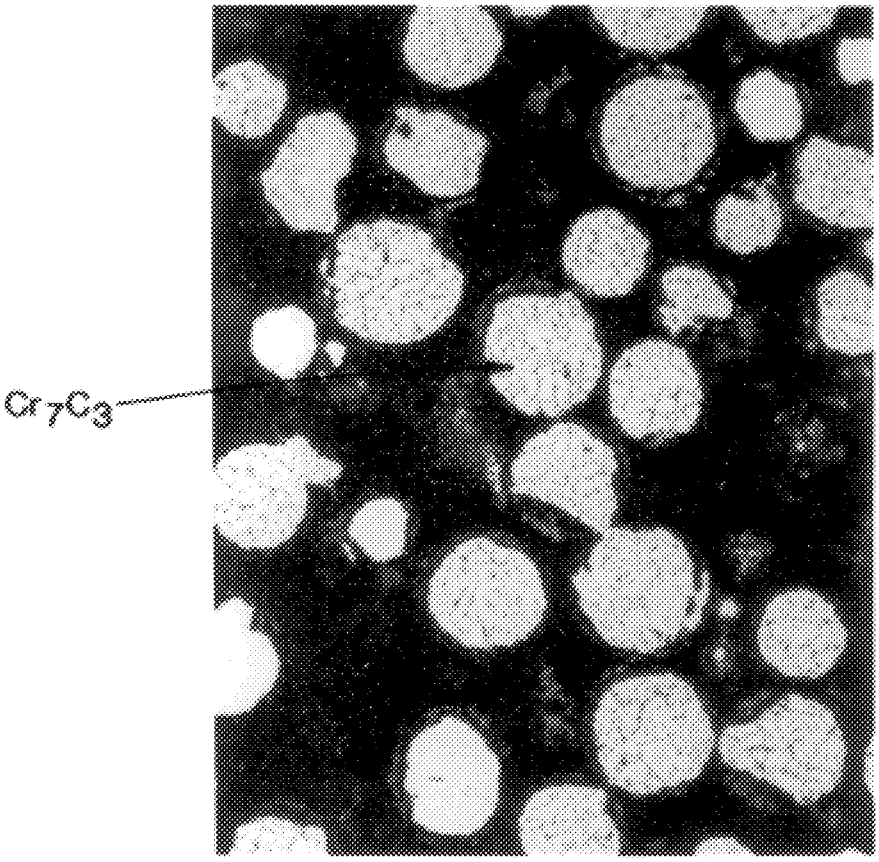
FIG. 2—Shows a photomicrograph at 200× magnification of atomized chromium carbide nickel chromium powder particles produced according to the invention (Example 2) containing large carbide grains ($Cr_7C_3$) resulting from a high carbon and high chromium level.

A mixture of 32 wt % chromium carbide and 68 wt % of nickel chromium in the mixture was heated to about 1700° C. to produce a liquid stream. An atomizing fluid of argon gas at a pressure of 800 psi was used to break up the liquid stream into droplets and then the droplets solidified to form an atomized powder. The powder had a composition of about 88 wt % Cr, about 8 wt % Ni and about 4 wt % C (See FIG. 2).

EXAMPLE 3

Figure 3:
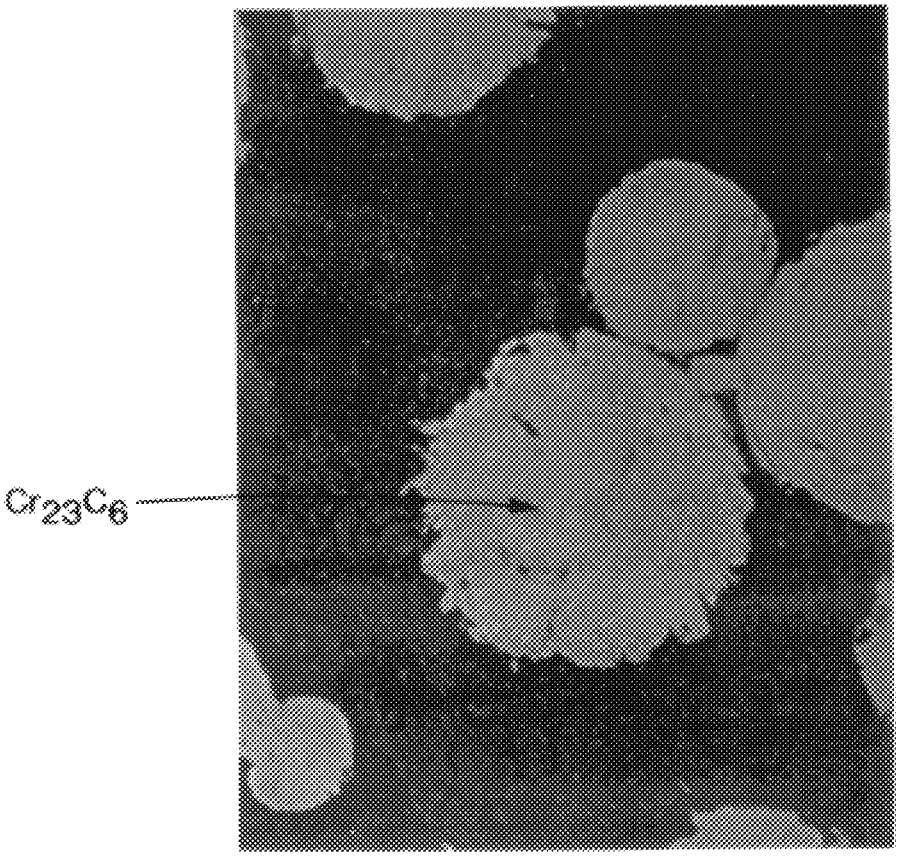
FIG. 3—Shows a photomicrograph at 500× magnification of atomized chromium carbide nickel chromium powder particles containing small carbide grains ($Cr_{23}C_6$) resulting from a low carbon and low chromium level (Example 3).

A mixture of 60 wt % chromium, 38.3 wt % of nickel and 1.7 wt % carbon in the mixture was heated to about 1700° C. to produce a liquid stream. An atomizing fluid of argon gas at a pressure of 800 psi was used to break up the liquid stream into droplets and then the droplets solidified to form an atomized powder. The powder had a composition of 60 wt % Cr, 38.3 wt % Ni and 1.7 wt % C (See FIG. 3).

EXAMPLE 4

Figure 4:
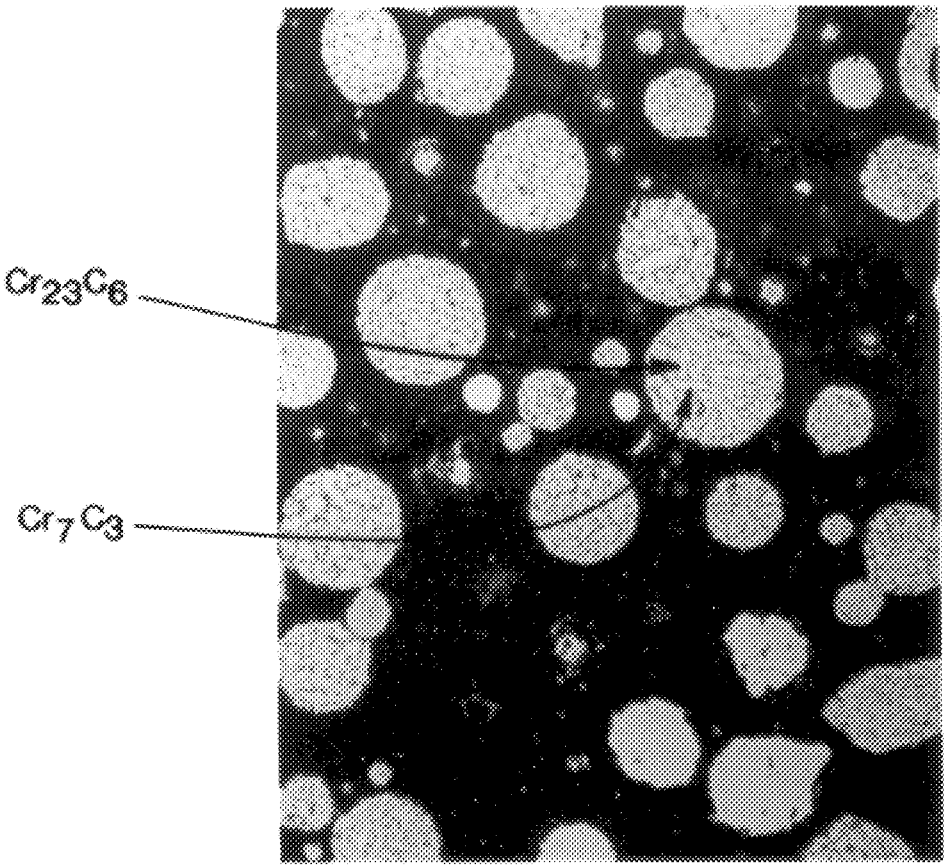
FIG. 4—Shows a photomicrograph at 200× magnification of chromium carbide nickel chromium powder particles similar to FIG. 1, with large carbide grains ($Cr_7C_3$ and $Cr_{23}C_6$) resulting from a medium carbon and medium chromium level (Example 4).

A mixture of 11.5 wt % chromium carbide, 65.5 wt % Cr, 21 wt % of nickel and 2 wt % carbon in the mixture was heated to about 1700° C. to produce a liquid stream. An atomizing fluid of argon gas at a pressure of 800 psi was used to break up the liquid stream into droplets and then the droplets solidified to form an atomized powder. The powder had a composition of about 75.5 wt % Cr, 21 wt % Ni and about 3.5 wt % C (See FIG. 4).

Preferred atomized powder produced using the method of this invention would be as follows:

| | Powders | | | | |
|---|---|---|---|---|---|
| | Cr | Ni | C | B | Si |
| | Weight percent of the powder | | | | |
| 1. | 60 | 35 | 5 | — | — |
| 2. | 60 | 36 | 4 | — | — |
| 3. | 60 | 37.5 | 2.5 | — | — |
| 4. | 60 | 38.3 | 1.7 | — | — |
| 5. | 63 | 34.4 | 2.6 | — | — |
| 6. | 58 | 39.7 | 2.3 | — | — |
| 7. | 73 | 23.8 | 3.2 | — | — |
| 8. | 78 | 18.45 | 3.5 | 0.05 | — |
| 9. | 83 | 13.2 | 3.8 | — | — |
| 10. | 75 | 19.95 | 5 | 0.05 | — |
| 11. | 75.5 | 21 | 3.5 | — | — |
| 12. | 75 | 23.3 | 1.7 | — | — |
| 13. | 82 | 12.7 | 5.3 | — | — |
| 14. | 86.5 | 8 | 5.5 | — | — |
| 15. | 88 | 7.9 | 4 | 0.1 | — |
| 16. | 88 | 10 | 2 | — | — |
| 17. | 88 | 8 | 4 | — | — |
| 18. | 82 | 11.5 | 5.5 | — | 1 |
| 19. | 75 | 20.5 | 3.5 | 1 | — |
| 20. | 82 | 12.5 | 5 | 0.5 | — |
| 21. | 87 | 8 | 4 | 1 | — |

While the invention has been described above in detail with reference to specific embodiments, various changes and modifications which fall within the spirit of the invention and scope of the appended claims will become apparent to those skilled in this art. The invention is therefore only intended to be limited by the appended claims or their equivalents.

What is claimed:

1. A method for producing an atomized powder of chromium carbide particles dispersed in a nickel chromium matrix, comprising the steps of melting chromium, carbon and nickel to form a molten liquid stream and then impinging an atomizing fluid selected from the group consisting of gas, liquid, and mixtures thereof at a pressure sufficient to break up the liquid stream into droplets having a diameter between 1 and 300 micrometers and then solidifying the droplets to form an atomized powder of chromium carbide phases dispersed in a metal nickel chromium matrix, said matrix comprising chromium in an amount in weight percent of the atomized powder from 55 to 92; nickel in an amount in weight percent of 5 to 40 of the atomized powder; and carbon in an amount in weight percent of 1 to 10 of the atomized powder.

2. The method of claim 1 wherein the molten liquid stream is produced using at least two constituents from the group consisting of chromium carbide compound, nickel chromium alloy, chromium, nickel, and carbon.

3. The method of claim 2 wherein the molten liquid stream is produced using chromium carbide compounds and nickel and chromium.

4. The method of claim 1 wherein the atomizing fluid is gas and the gas is used to break the molten liquid stream into droplets.

5. The method of claim 1 wherein the atomizing fluid is liquid and the high pressure liquid is used to break up the molten liquid stream into droplets.

6. The method of claim 1 wherein the chromium is present in an amount of between 70 and 90 wt %, the nickel is present in an amount between 5 and 28 wt % and the carbon present in an amount between 2 and 6 wt %.

7. The method of claim 1 wherein the chromium carbide particles comprise a carbide selected from the group of $Cr_7C_3$, $Cr_{23}C_6$ and mixtures thereof.

8. The method of claim 1 wherein the chromium carbide particles are sized between 0.1 and 30 micrometers in their largest dimension.

9. The method of claim 1 wherein the ratio of nickel to chromium in a metallic matrix in the atomized powder is from 0.30 to 0.70 by weight.

10. The method of claim 1 wherein the powder particles are substantially spherical in shape.

11. The method of claim 7 wherein the atomized powder of chromium carbide particles dispersed in a nickel chromium matrix contains chromium in an amount in weight percent of the atomized powder from 55 to 92; nickel in an amount in weight percent of 5 to 40 of the atomized powder; and carbon in an amount in weight percent of 1 to 10 of the atomized powder.

12. The method of claim 3 wherein the atomized powder of chromium carbide particles dispersed in a nickel chromium matrix contains chromium in an amount in weight percent of the atomized powder from 55 to 92; nickel in an amount in weight percent of 5 to 40 of the atomized powder; and carbon in an amount in weight percent of 1 to 10 of the atomized powder.

13. The method of claim 1 wherein the atomized powder produced is selected from the group consisting of about 88 wt % chromium, about 8 wt % nickel and about 4 wt % carbon; and about 75.5 wt % chromium, about 21 wt % nickel and about 3.5 wt % carbon.

14. The method of claim 1 wherein the atomized powder contains less than a total of 5 weight percent of at least one element selected from the group consisting of boron, silicon, manganese and phosphorus.

15. The method of claim 1 wherein the following step is added:

thermally depositing the atomized powder onto a substrate to produce an adherent coating on the substrate.

16. The method of claim 15 wherein the atomizing fluid is liquid and the high pressure liquid is used to break up the liquid stream into droplets.

17. The method of claim 15 wherein the atomized powder of chromium carbide particles dispersed in a nickel chromium matrix contains chromium in an amount in weight percent of the atomized powder from 55 to 92; nickel in an amount in weight percent of 5 to 40 of the atomized powder; and carbon in an amount in weight percent of 1 to 10 of the atomized powder.

18. An atomized powder of chromium carbide particles dispersed in a nickel chromium matrix contains chromium in an amount in weight percent of the atomized powder from 55 to 92; nickel in an amount in weight percent of 5 to 40 of the atomized powder; and carbon in an amount in weight percent of 1 to 10 of the atomized powder.

19. The atomized powder of claim 18 wherein the atomized powder is selected from the group consisting of about 88 wt % chromium, about 8 wt % nickel and about 4 wt % carbon; and about 75.5 wt % chromium, about 21 wt % nickel and about 3.5 wt % carbon.

* * * * *